United States Patent [19]

Woodward

[11] Patent Number: 4,682,827

[45] Date of Patent: Jul. 28, 1987

[54] COMBINATION TOY BOX-DRAFTING TABLE

[76] Inventor: Eldon D. Woodward, 1118 E. Avenue J-2, Lancaster, Calif. 93534

[21] Appl. No.: 769,403

[22] Filed: Aug. 26, 1985

[51] Int. Cl.[4] ..... A47B 27/00

[52] U.S. Cl. ..... 312/231; 312/107; 312/205; 312/233; 446/482

[58] Field of Search ..... 312/205, 250, 231, 29, 312/233, 279, 107; 446/482

[56] References Cited

U.S. PATENT DOCUMENTS

| | | | |
|---|---|---|---|
| 171,683 | 1/1876 | Miller | 312/205 |
| 219,263 | 9/1879 | Hosford | 312/208 X |
| 396,813 | 1/1889 | France | 312/29 X |
| 398,095 | 2/1889 | Thompson | 312/29 |
| 486,435 | 11/1892 | Clonde | 312/29 |
| 746,758 | 12/1903 | Stiggleman | 312/205 X |
| 1,181,739 | 5/1916 | Clark | 312/233 |
| 1,398,237 | 11/1921 | Michaels | 312/205 X |
| 1,729,491 | 9/1929 | Rygl | 312/205 |
| 2,589,319 | 3/1952 | Albrecht | 312/205 X |
| 2,675,288 | 4/1954 | Usher | 312/231 X |

FOREIGN PATENT DOCUMENTS

| | | | |
|---|---|---|---|
| 804100 | 10/1936 | France | 312/205 |

*Primary Examiner*—Kenneth J. Dorner
*Assistant Examiner*—Thomas A. Rendos
*Attorney, Agent, or Firm*—John J. Posta, Jr.

[57] ABSTRACT

The box-table combination includes a lower open topped toy box with central storage space, and an upper open bottomed drafting table releasably secured to the top of the box and nestable therein when disconnected therefrom for easy transportation. The drafting table has generally vertical side and rear walls and a closed top having an upwardly and rearwardly sloping (at about 40°) front drafting portion and an about horizontal rear portion, all defining a central storage cavity within which staggered horizontal shelves are disposed. The rear ends of the shelves are slideably disposed in and readily removable from slats in the table rear wall. Access to the shelves is through a plurality of child-safe side folding hinged panel members in the table front portion. Access to the central storage space is through a drawer slidably received therein and extending out of the box, and thrugh the folding panels. The combination box-table may be of wood or the like, is inexpensive, compact, durble and multi-functional and may have casters and finger grips to assist lifting and manipulating it. It is attractive and resembles a small desk.

11 Claims, 4 Drawing Figures

COMBINATION TOY BOX-DRAFTING TABLE

BACKGROUND OF THE INVENTION

1. Field of the Invention

The present invention generally relates to storage and drafting means and, more particularly, to a compact combination toy box and drafting table.

2. Prior Art

Toy boxes usually are constructed with heavy hinged lids which unfortunately may accidentally fall on a child's head or body, causing severe injury and, in some instances, trapping the child within the toy box, out of sight and beyond help. Toy boxes of any reasonably large capacity also usually have no adequate provision for storage therein of small delicate toys, such as miniature figurines, shells, rings and the like. Such objects, if placed in the toy box are easily subject to damage by the mass of large toys therein and cannot be easily located therein and withdrawn therefrom.

Accordingly, there is a need for an improved toy box which has improved child safety means, and in which it is easier and more convenient to store both small and large toys without damage and with improved ease of location thereof.

Drafting or drawing tables for children are frequently separate bulky devices with a tilted school desk-type appearance or are merely the flat top of boxes or the like. In the latter case, the flat horizontal drafting or drawing surface impedes the proper use of drawing and drafting equipment. It would be desireable to provide an improved drafting table which would be of minimal cost and size and of improved appearance, and would provide a properly angled drafting surface. Preferably, the drafting table should also provide usable toy storage space.

SUMMARY OF THE INVENTION

The improved combination toy storage box and drafting table of the present invention satisfies all the above needs. The box-table is substantially as set forth in the Abstract above. Thus, it comprises an open bottomed drafting table releasably secured to the open top of a toy box. The table when detached from the box is readily nestable therein for ease of storage and transportation of the combination. The front portion of the table top is upwardly and rearwardly sloped to provide an ideal drafting surface.

The box-table features a child safety upper opening in the front portion of the top. The opening is covered by a plurality of side hinged panel members to allow easy access to the toy storage space therein without the danger that a heavy vertically raisable lid would provide. Thus, the child using the table portion merely has to side fold the panel members to expose the tables interior and to be able to use the removable shelves therein which are ideal for safe storage of small toys and curios thereon. When the shelves are removed, the large toy storage space in the toy box forming the lower part of the combination is readily accessible. That space is also accessible by reaching down in front of the shelves when they are in place on the table. That space is most readily accessible, however, by sliding out an open topped horizontally disposed drawer in the bottom of the storage space in the box.

The combination box-table is compact, has the attractive appearance of a small desk and the multiple functions of a toy box and drafting table. It is easily moveable on casters and can be lifted by side finger lift grips. It can be made of wood, plastic, metal or the like and is durable. Further features are set forth in the following detailed description and accompanying drawings.

DRAWINGS

DETAILED DESCRIPTION

Figure 1:
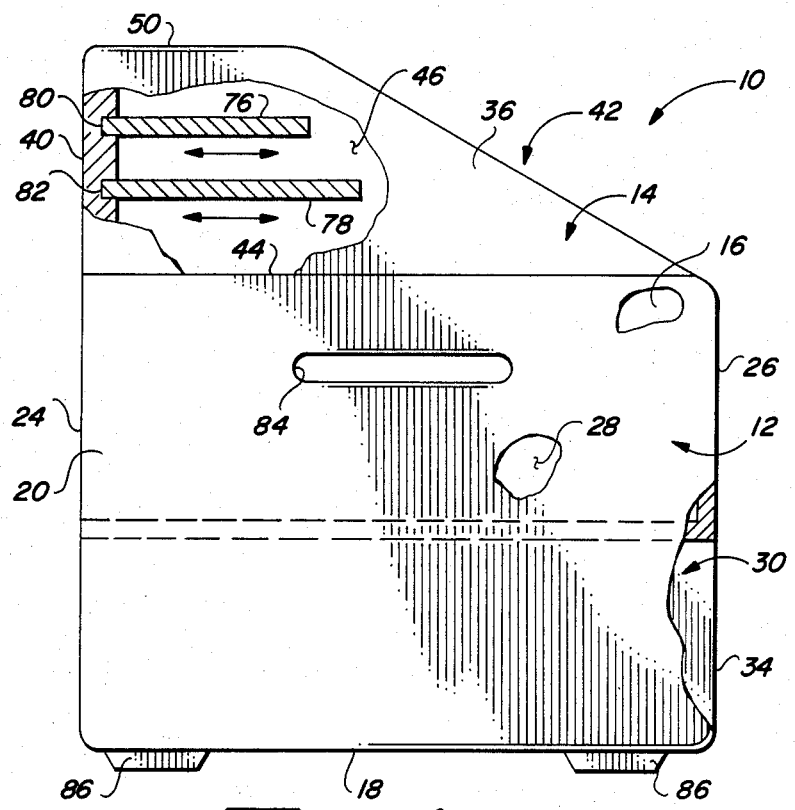
FIG. 1 is a schematic side elevation, partly broken away, of a first preferred embodiment of the improved combination toy box-drafting table of the present invention.
Figure 2:
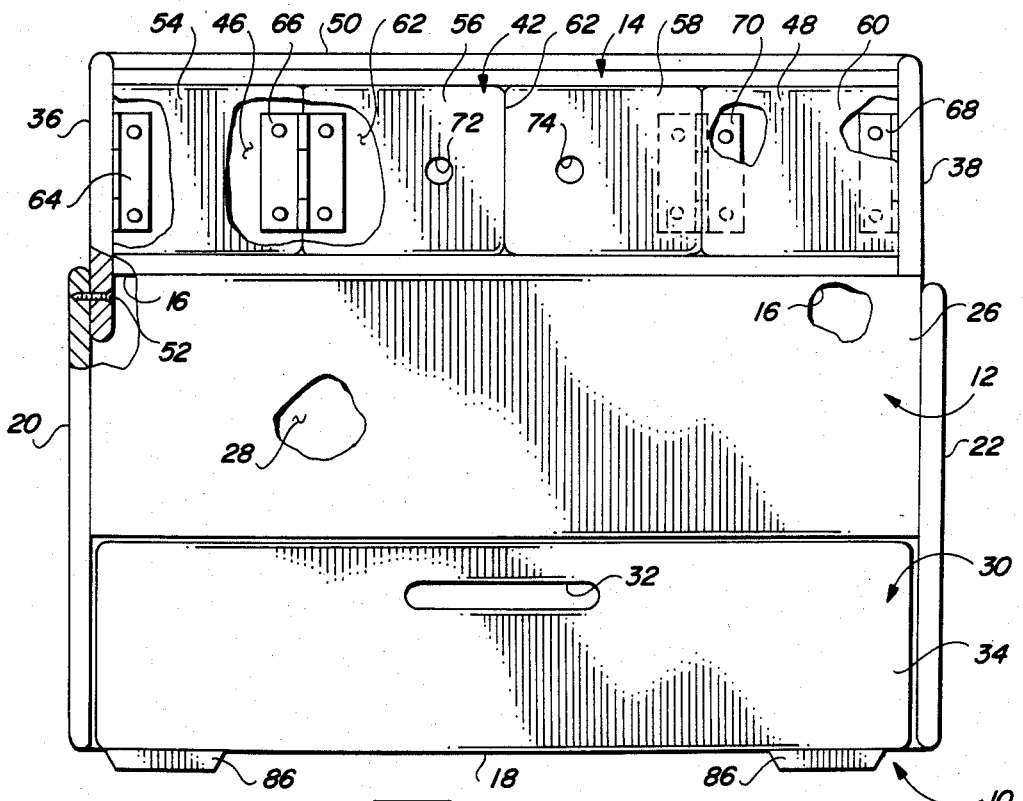
FIG. 2 is a schematic front elevation, partly broken away, of the toy box-drafting table of FIG. 1.

FIGS. 1 and 2

Now referring more particularly to a first preferred embodiment of the combination toy box-drafting table, as depicted schematically in FIGS. 1 and 2, combination 10 is shown. Combination 10 comprises a lower toy box 12 and an upper drafting table 14 releasably secured to the top 16 of toy box 12. Thus, toy box 12 may be of any suitable shape and size, but preferably is rectangular or square. It includes a generally horizontal closed bottom 18, connected to generally vertical walls comprising two sides 20 and 22, a rear 24 and front 26 to define open top 16 and a central storage space 28 communicating therewith.

Box 12 is fitted with an open topped horizontally forwardly and rearwardly sliding drawer 30, shown in FIGS. 1 and 2 in the closed position residing within the lower portion of storage space 28. Drawer 30 is provided with a front drawer pull 32 in the form of a horizontal hand slot and may also be provided with a drawer slide guide (not shown) or other conventional means to facilitate movement of drawer 30 to and from storage space 28. Large toys can be placed in drawer 30 when in or out of space 28. In box 12, drawer 30 is shown in the closed position with its front 34 flush with front 26 for a neat appearance.

Drafting table 14 comprises a pair of vertical side walls 36 and 38 and vertical rear wall 40 interconnected to a closed top 42 to define an open bottom 44 and central storage cavity 46. Top 42 comprises an upwardly and rearwardly sloping (preferably at about 30°–50°, most preferably about 40°) front drafting portion 48 and a horizontal rear portion 50.

Table 14 is dimensioned so that it can nest within storage space 28 when it is detached from the top 16 of box 12 and will reat securely on box 12 when connected thereto. Thus, table 14 can be releasably secured to box 12 by screws 52 or the like passing through the upper portions of sides 20 and 22 and the lower portions of sides 36 and 38, respectively, as illustrated in FIG. 2. Table 14 is low enough, narrow enough and short enough front to rear to fit into space 28 for easy storage, transportation and the like.

Table 14 is provided in front portion 48 of top 42 with four side folding panel members 54, 56, 58 and 60 covering an opening 62. Member 54 is hinged to side 36 and to member 56 by hinges 64 and 66, respectively, so as to readily fold open with member 54 towards side 36 to expose opening 62. Similarly, member 60 is connected by hinge 68 to side 38 and by hinge 70 to member 58 to readily fold open with member 58 towards side 38 to expose opening 62. One or more members 54, 56, 58 and 60 may be backed by braces (not shown) to permit them, when closed, to form a firm drafting surface. Finger holes 72 and 74 may be provided in panels 56 and 58 to facilitate folding and unfolding panel members 54, 56, 58 and 60.

Opening 62 provides access to storage cavity 46 and to a pair of shelves 76 and 78 slideably disposed in a horizontal position in vertically staggered array (FIG. 1) in slots 80 and 82, respectively, in rear wall 40, with the leading edge of shelves 76 rearwardly of the leading edge of shelf 78. Shelves 76 and 78 are dimensioned to provide access from cavity 46 to storage space 28 in front of shelves 76 and 78. Moreover, shelves 76 and 78 can be readily removed, if desired, to increase that accessibility. Shelves 76 and 78 provide means for safe storage of small toys, curios and the like with easy access thereto through opening 62.

It will be understood that combination box-table 10 can be fabricated of wood, plastic, metal or the like and preferably is easy to lift and maneuver, as by hand slots 84 disposed in sides 20 and 22. Combination box-table 10 may be provided with feet 86 for convenience and an improved appearance. Combination box-table is child-safe, inexpensive, durable and attractive and resembles a desk, but has the multiple functions of a drafting table and storage box for large and small toys, while providing multiple access paths to the interior storage areas thereof.

Figure 3:
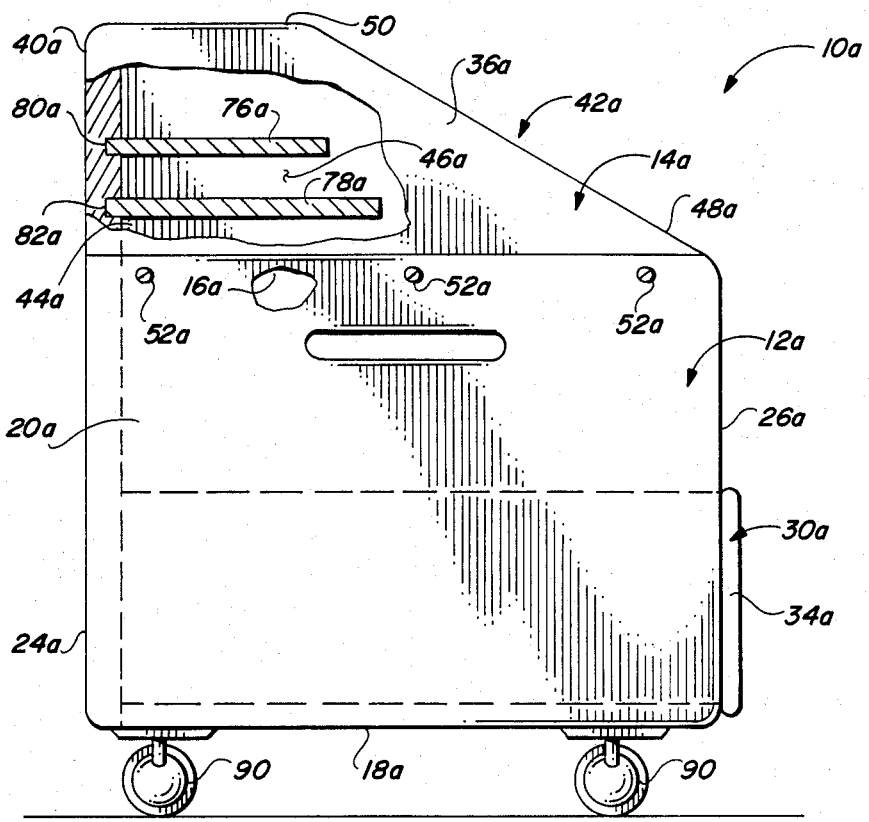
FIG. 3 is a schematic side elevation, partly broken away, of a second preferred embodiment of the improved toy box-drafting table of the present invention; and, FIG. 4 is a schematic front elevation, partly broken away, of the toy box-drafting table of FIG. 3.
Figure 4:
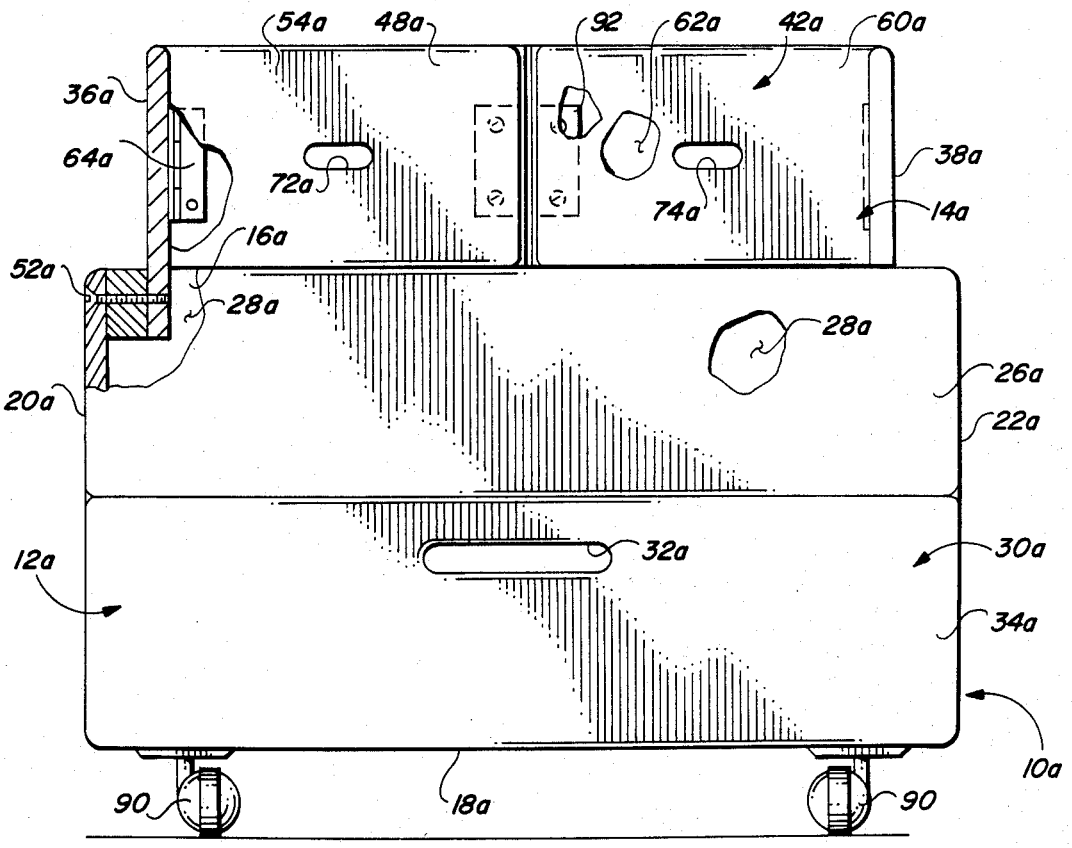

FIGS. 3 and 4

A second preferred embodiment of the improved combination toy box-drafting table of the present invention is schematically depicted in FIGS. 3 and 4. Thus, combination 10*a* is shown. Components thereof similar to those of combination 10 bear the same numerals, but are succeeded by the letter "a". Combination box-table 10*a* is identical to combination box-table 10 except that its table 14*a* is relatively narrower with respect to box 12*a*. Moreover, front 34*a* of drawer 30*a* protrudes forward of front 26*a*, box 12*a* is on casters 90 and there are only two panels 54*a* and 60*a* and they are hinged to each other by hinge 92. Panel 54*a* is hinged to side 36*a* by hinge 64*a*. Panels 54*a* and 60*a* fold toward side 36*a* to expose opening 62*a*, cavity 46*a* and shelves 76*a* and 78*a*. Screws 52*a* releasably connect table 14*a* to box 12*a*. Combination box-table 10*a* has the advantages of combination box-table 10.

Various other changes, modifications, alterations and additions can be made in the improved combination toy box-drafting table of the present invention, its components and their parameters. All such changes, modifications, alterations and additions as are within the scope of the appended claims form part of the present invention.

What is claimed is:

1. An improved combination toy storage box and drafting table, said box-table comprising, in combination:

(a) a storage box having interconnected upstanding front, rear and side walls and a generally horizontal closed bottom connected thereto and an open top defining a central storage space;

(b) a drafting table resting on said top of said box and releasably connected thereto, said table including a pair of spaced upraised sidewalls, and an upraised rear wall, interconnected thereto and to a closed top, said table having an open bottom and a central storage cavity, said table top including an upwardly and rearwardly sloped front drafting portion connected to an about horizontal rear portion, said entire table being dimensioned so as to be nestable within a portion of the central storage space of said box without prior disassembly of said entire table for transportation therein; and, (c) access means in at least one of said box and table for access to at least one of said central storage space and storage cavity.

2. The improved combination toy box-drafting table of claim 1 wherein said access means includes in the front portion of said top side, folding members for access to said storage cavity thereof, said folding members being folded horizontally rather than vertically.

3. The improved combination toy box-drafting table of claim 2 wherein there are four of said folding members hinged to form two pairs openable to opposite sides of said table.

4. The improved combination toy box-drafting table of claim 2 wherein the upraised rear wall of said drafting table has at least one slot therein, wherein at least one generally horizontal shelf is slidably disposed in the slot in said drafting table rear wall and extends into said storage cavity when the drafting table is in an operable position, and wherein said shelf can readily be removed from said slot to enable nesting of said drafting table within said central storage place.

5. The improved combination toy box-drafting table of claim 4, wherein said shelves are vertically staggered and readily removable for access to said toy box storage space.

6. The improved combination toy box-drafting table of claim 2 wherein said folding panel members include finger grips and wherein said toy box is supported on casters.

7. The improved combination toy box-drafting table of claim 6 wherein said storage box includes an openable drawer with open top disposed in said central storage space and slidable outwardly of said box.

8. The improved combination toy box-drafting table of claim 7 wherein said drawer includes a drawer pull and wherein said box sidewalls include lift grips for moving said toy box-drafting table.

9. The improved combination toy box-drafting table of claim 8 wherein said drawer pull, finger grips and lift grips comprise finger-receiving openings in said toy box-drafting table.

10. The improved combination toy box-drafting table of claim 9 wherein said table comprises a plurality of interconnected wood panels and wherein said table top front portion rises rearwardly at an angle of about 40° to provide a convenient drafting surface.

11. The improved combination toy box-drafting table of claim 2 wherein there are at least a pair of said side folding members hinged to each other and one side of said table for opening towards said one side.

* * * * *